US011097552B2

(12) United States Patent
Ozawa et al.

(10) Patent No.: US 11,097,552 B2
(45) Date of Patent: Aug. 24, 2021

(54) DROPLET DISCHARGE APPARATUS

(71) Applicant: SEIKO EPSON CORPORATION, Tokyo (JP)

(72) Inventors: Kinya Ozawa, Shiojiri (JP); Takayuki Yokoyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/831,156

(22) Filed: Mar. 26, 2020

(65) Prior Publication Data

US 2020/0307244 A1 Oct. 1, 2020

(30) Foreign Application Priority Data

Mar. 27, 2019 (JP) ..... JP2019-061302

(51) Int. Cl.
*B41J 2/175* (2006.01)
*B41J 2/165* (2006.01)

(52) U.S. Cl.
CPC ..... *B41J 2/17596* (2013.01); *B41J 2/16523* (2013.01); *B41J 2/16552* (2013.01)

(58) Field of Classification Search
CPC . B41J 2/17596; B41J 2/16552; B41J 2/16523
See application file for complete search history.

(56) References Cited

U.S. PATENT DOCUMENTS

2016/0031222 A1* 2/2016 Kobayashi ..... B41J 2/16523 347/28
2020/0307239 A1* 10/2020 Ozawa ..... B41J 2/16523

FOREIGN PATENT DOCUMENTS

JP 2013-129081 7/2013

* cited by examiner

*Primary Examiner* — Sharon Polk
(74) *Attorney, Agent, or Firm* — Workman Nydegger

(57) ABSTRACT

A droplet discharge apparatus includes a first head, a first-ink pack storing first ink, a second head, a second ink pack storing second ink, a cleaning liquid container storing cleaning liquid, a common flow path system, a cleaning liquid flow path, a first pump feeding the first ink from the first ink pack to the second ink pack through the common flow path system, a second pump feeding the cleaning liquid from the cleaning liquid container to the first ink pack through the cleaning liquid flow path and the common flow path system, a first valve controlling a liquid flow rate between the common flow path system and the first ink pack, a second valve controlling a liquid flow rate between the common flow path system and the second ink pack, a third valve controlling a liquid flow rate between the common flow path system and the cleaning liquid flow path, and a control unit, wherein the common flow path system, the first valve, and the second valve are located higher than a liquid surface in the first ink pack and a liquid surface in the second ink pack, and wherein the control unit transfers the first ink from the first ink pack to the second ink pack, and transfers the cleaning liquid from the cleaning liquid container to the first ink pack.

11 Claims, 9 Drawing Sheets

DROPLET DISCHARGE APPARATUS

The present application is based on, and claims priority from JP Application Serial Number 2019-061302, filed Mar. 27, 2019, the disclosure of which is hereby incorporated by reference herein in its entirety.

BACKGROUND

1. Technical Field

The present disclosure relates to a droplet discharge apparatus.

2. Related Art

The droplet discharge apparatus is an apparatus that discharges liquid droplets from fine nozzles and attaches the liquid droplets to a recording medium. The droplet discharge apparatus has a characteristic to be able to quickly record a high-resolution and high-quality image. In an ink jet recording method using the droplet discharge apparatus, an image is formed by discharging inks of a plurality of colors.

The droplet discharge apparatus is also used for textile printing. The textile printing may be performed by, for example, using an ink set of colors including cyan (C), magenta (M), yellow (Y), black (BK), and the like, and mixing colors and adjusting size and density of dots on the textile. However, a desired color may not be obtained by such adjusting. In such a case, an ink for obtaining a desired color is prepared in advance and the ink may be discharged from the droplet discharge apparatus. Therefore, a droplet discharge apparatus is required where a different color ink or an ink having different components can be replaced so as to be able to use a color other than C, M, Y, and BK.

JP-A-2013-129081 discloses a technique where ink flow paths of Y, M, C, and BK are coupled to one head, and when replacing ink to be supplied to the head, the ink is returned to a liquid storage tank and an empty prevention liquid that prevents a head flow path from being empty is supplied to the head flow path.

However, when ink is to be prepared in advance in the technique described in JP-A-2013-129081, the liquid storage tank is required to be provided for each color. Further, when the amount of ink to be used is large as in a printing field, the size of the tank needs to be large, and waste often occurs in the prepared ink when replacing the ink.

SUMMARY

According to an aspect of the present disclosure, a droplet discharge apparatus includes a first head, a first ink pack that stores first ink to be supplied to the first head, a second head, a second ink pack that stores second ink to be supplied to the second head, a cleaning liquid container that stores cleaning liquid, a common flow path system that couples the first ink pack with the second ink pack, a cleaning liquid flow path that couples the common flow path system with the cleaning liquid container, a first valve that controls a liquid flow rate between the common flow path system and the first ink pack, a second valve that controls a liquid flow rate between the common flow path system and the second ink pack, a third valve that controls a liquid flow rate between the common flow path system and the cleaning liquid flow path, a first pump that is provided in the common flow path system and feeds the first ink from the first ink pack to the second ink pack through the common flow path system, a second pump that feeds the cleaning liquid from the cleaning liquid container to the first ink pack through the cleaning liquid flow path and the common flow path system, and a control unit.

When the droplet discharge apparatus is installed in a state in which the first ink is discharged from the first head, the common flow path system, the first valve, and the second valve are located higher than a liquid surface of the first ink in the first ink pack and a liquid surface of the second ink in the second ink pack, and the control unit transfers the first ink stored in the first ink pack to the second ink pack through the common flow path system by controlling the first valve, the second valve, the third valve, and the first pump, and transfers the cleaning liquid stored in the cleaning liquid container to the first ink pack through the cleaning liquid flow path and the common flow path system by controlling the first valve, the second valve, the third valve, and the second pump.

According to the aspect described above, the droplet discharge apparatus includes a waste liquid container, a waste liquid flow path system that couples the common flow path system with the waste liquid container, a fourth valve that controls a liquid flow rate between the common flow path system and the waste liquid flow path system, and a third pump that feeds the cleaning liquid transferred to the first ink pack from the first ink pack to the waste liquid container through the waste liquid flow path system, and the control unit may transfer the cleaning liquid transferred to the first ink pack to the waste liquid container through the waste liquid flow path system by controlling the first valve, the fourth valve, and the third pump.

According to any one of the aspects described above, the droplet discharge apparatus includes a fourth pump that feeds the cleaning liquid from the cleaning liquid container to the waste liquid container through the cleaning liquid flow path, the common flow path system, and the waste liquid flow path system, and the control unit may transfer the cleaning liquid stored in the cleaning liquid container to the waste liquid container through the cleaning liquid flow path, the common flow path system, and the waste liquid flow path system by controlling the first valve, the second valve, the third valve, the fourth valve, and the fourth pump.

According to any one of the aspects described above, in the droplet discharge apparatus, the waste liquid container may store liquid discharged from the first head.

According to any one of the aspects described above, the droplet discharge apparatus includes a first flow path system that couples the first head with the first ink pack, and a fifth valve provided in the first flow path system, and the control unit may transfer the cleaning liquid transferred to the first ink pack to the first head through the first flow path system by controlling the fifth valve.

According to any one of the aspects described above, in the droplet discharge apparatus, the control unit may reduce a liquid flow rate of the first flow path system by controlling the fifth valve when transferring the cleaning liquid stored in the cleaning liquid container to the first ink pack through the cleaning liquid flow path and the common flow path system.

According to any one of the aspects described above, in the droplet discharge apparatus, the first flow path system includes a first auxiliary container coupled to the first head, and a fifth pump provided between the first auxiliary container and the first ink pack, and the control unit may collect the first ink stored in the first auxiliary container into the first ink pack by controlling the fifth pump before transferring the first ink stored in the first ink pack to the second ink pack through the common flow path system.

According to any one of the aspects described above, the droplet discharge apparatus includes a second flow path system that couples the second head with the second ink pack, a sixth valve provided in the second flow path system, a first sensor that detects an amount of liquid in the first ink pack, a second sensor that detects an amount of liquid in the second ink pack, and a second auxiliary container coupled to the second head, and the control unit may transfer the second ink in the second ink pack to the second auxiliary container by controlling the sixth valve when a total amount of the amount of liquid in the first ink pack detected by the first sensor and the amount of liquid in the second ink pack detected by the second sensor exceeds a predetermined amount before transferring the first ink stored in the first ink pack to the second ink pack through the common flow path system.

According to any one of the aspects described above, the droplet discharge apparatus includes a second flow path system that couples the second head with the second ink pack, a sixth valve provided in the second flow path system, a second sensor that detects an amount of liquid in the second ink pack, and a second auxiliary container coupled to the second head, and the control unit may transfer the second ink in the second ink pack to the second auxiliary container by controlling the sixth valve when the second sensor detects that the amount of liquid in the second ink pack exceeds a predetermined amount.

According to any one of the aspects described above, the droplet discharge apparatus includes a first sensor that detects an amount of liquid in the first ink pack, and a second sensor that detects an amount of liquid in the second ink pack, and the control unit may transfer the first ink stored in the first ink pack to the second ink pack through the common flow path system when the amount of liquid in the first ink pack detected by the first sensor is smaller than the amount of liquid in the second ink pack detected by the second sensor.

According to any one of the aspects described above, in the droplet discharge apparatus, the first ink and the second ink may be the same ink.

DESCRIPTION OF EXEMPLARY EMBODIMENTS

Hereinafter, an embodiment of the present disclosure will be described. The embodiment described below describes an example of the present disclosure. The present disclosure is not limited at all by the embodiment described below. The present disclosure includes various modified examples implemented within the scope not changing the gist of the present disclosure. All of the configurations described below are not necessarily essential components of the present disclosure.

1. Configuration of Droplet Discharge Apparatus

Figure 1:
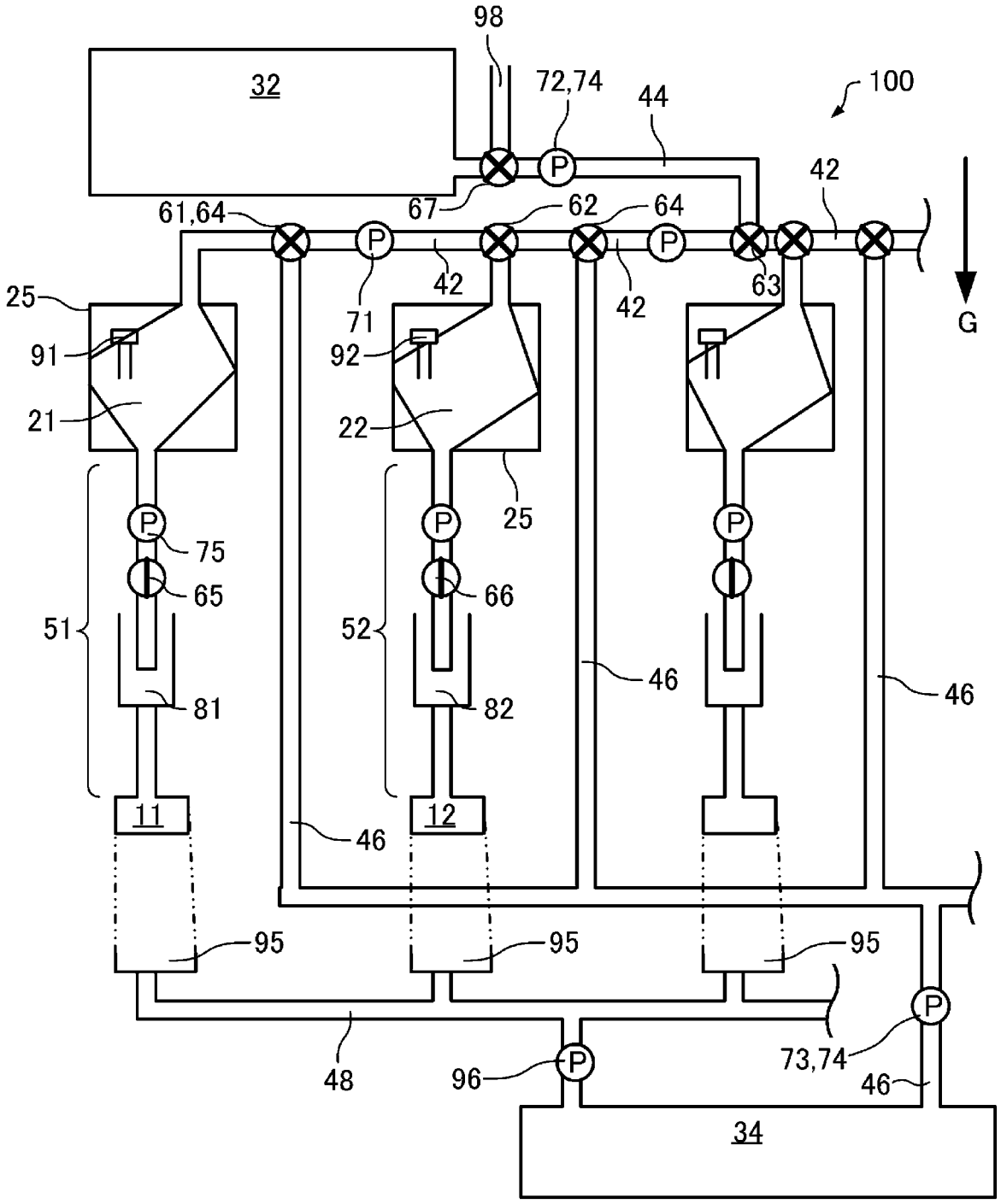
FIG. 1 is a schematic diagram of a main part of a droplet discharge apparatus according to an embodiment.

FIG. 1 is a schematic diagram of a main part of a droplet discharge apparatus 100 according to the embodiment. The droplet discharge apparatus 100 includes a first head 11, a first ink pack 21 that stores first ink to be supplied to the first head 11, a second head 12, a second ink pack 22 that stores second ink to be supplied to the second head 12, a cleaning liquid container 32 that stores cleaning liquid, a common flow path system 42 that couples the first ink pack 21 with the second ink pack 22, a cleaning liquid flow path 44 that couples the common flow path system 42 with the cleaning liquid container 32, a first valve 61 that controls a liquid flow rate between the common flow path system 42 and the first ink pack 21, a second valve 62 that controls a liquid flow rate between the common flow path system 42 and the second ink pack 22, a third valve 63 that controls a liquid flow rate between the common flow path system 42 and the cleaning liquid flow path 44, a first pump 71 that is provided in the common flow path system 42 and feeds the first ink from the first ink pack 21 to the second ink pack 22 through the common flow path system 42, a second pump 72 and feeds the cleaning liquid from the cleaning liquid container 32 to the first ink pack 21 through the cleaning liquid flow path 44 and the common flow path system 42, and a control unit not shown in the figures.

When the droplet discharge apparatus 100 is installed in a state in which the first ink is discharged from the first head 11, the common flow path system 42, the first valve 61, and the second valve 62 are located higher than a liquid surface 21*a* of the first ink in the first ink pack 21 and a liquid surface 22*a* of the second ink in the second ink pack 22.

The droplet discharge apparatus 100 further includes a first flow path system 51 that couples the first head 11 with the first ink pack 21, a first auxiliary container 81 that is coupled to the first head 11, a second flow path system 52 that couples the second head 12 with the second ink pack 22, a second auxiliary container 82 that is coupled to the second head 12, a first sensor 91 that detects the amount of liquid in the first ink pack 21, a second sensor 92 that detects the amount of liquid in the second ink pack 22, a waste liquid container 34, a waste liquid flow path system 46 that couples the common flow path system 42 with the waste liquid container 34, a fourth valve 64 that controls a liquid flow rate between the common flow path system 42 and the waste liquid flow path system 46, a fifth valve 65 provided in the first flow path system 51, a sixth valve 66 provided in the second flow path system 52, a third pump 73 that feeds the cleaning liquid transferred to the first ink pack 21 from the first ink pack 21 to the waste liquid container 34 through the common flow path system 42 and the waste liquid flow path system 46, a fourth pump 74 that feeds the cleaning liquid from the cleaning liquid container 32 to the waste liquid container 34 through the cleaning liquid flow path 44, the common flow path system 42, and the waste liquid flow path system 46, and a fifth pump 75 provided between the first auxiliary container 81 and the first ink pack 21.

The droplet discharge apparatus 100 further includes the first sensor 91 that detects the amount of liquid in the first ink pack 21 and the second sensor 92 that detects the amount of liquid in the second ink pack 22. The droplet discharge apparatus 100 further includes suction caps 95, which suck liquid in the first head 11 and the second head 12 from nozzles of the first head 11 and the second head 12, respectively. The suction caps 95 are coupled to a suction flow path 48 that depressurizes the insides of the suction caps 95 when the suction caps 95 cap the heads. The suction flow path 48 is provided with a sixth pump 96. The liquid transferred from the suction caps 95 is configured to be collected to the waste liquid container 34. Further, the droplet discharge apparatus 100 includes an air intake port 98 coupled to the cleaning liquid flow path 44 and a seventh valve 67 at a branch portion between the air intake port 98 and the cleaning liquid flow path 44.

1.1. Head

The droplet discharge apparatus 100 has a plurality of heads. The number of heads included in the droplet discharge apparatus 100 may be arbitrary as long as the number is two or more. The head discharges liquid such as ink supplied to the head as droplets from fine nozzles. The droplets discharged from the head is attached to, for example, a recording medium not shown in the figures. Thereby, an image can be recorded on the recording medium, or the recording medium can be printed. A method of the head is not limited, but the method is, for example, a piezoelectric method. These heads may discharge different colors of inks, respectively, or a plurality of heads may discharge the same color of ink.

In the description below, one of the plurality of heads included in the droplet discharge apparatus 100 is referred to as the "first head 11" and one of the heads other than the first head 11 is referred to as the "second head 12".

1.2. Ink and Cleaning Liquid

The ink used in the droplet discharge apparatus 100 is not limited as long as the ink can be discharged as droplets from the head described above. As the types of ink, there are, for example, dye ink, pigment ink, UV ink, and the like. The colors of ink are not particularly limited and may be cyan, magenta, yellow, black, and the like, or may be prepared special colors. The ink may be treatment liquid containing no color material or the like. The ink may contain an organic solvent, a surfactant, and other additive agents, which are commonly used.

In the description below, the ink to be supplied to the first head 11 is referred to as the "first ink", and the ink to be supplied to the second head 12 is referred to as the "second ink". In the present embodiment, as described below, when the first ink pack 21 is cleaned, the first ink is transferred to the second ink pack 22, so that it is preferable that the first ink and the second ink are the same. By doing so, the second ink stored in the second ink pack 22 can be maintained in a predetermined color even when the first ink is mixed in the second ink.

The cleaning liquid can clean insides of the ink packs, insides of the flow paths, and the like. In the droplet discharge apparatus 100, the cleaning liquid is stored in the cleaning liquid container 32 and is introduced to the common flow path system 42, the first ink pack 21, the first head 11, and the like through the cleaning liquid flow path 44 as needed. Thereby, ink packs and the like through which the cleaning liquid passes are cleaned. The composition of the cleaning liquid is, for example, water or organic solvent, and may contain additive agents such as a surfactant as needed.

In the present specification, at least one of the ink, the cleaning liquid, and a mixture liquid of the ink and the cleaning liquid may be referred to as "liquid".

1.3. Ink Pack

The droplet discharge apparatus 100 includes a plurality of ink packs that store ink to be supplied to the head. The number of the ink packs may be the same as the number of the heads. The ink pack stores ink and supplies the ink to a corresponding head. When replacing the ink, a predetermined ink is introduced to the ink pack after the cleaning liquid is introduced to the ink pack and the ink pack is cleaned.

In the droplet discharge apparatus 100, the ink pack is stored in an ink pack case 25. The ink pack has a bag shape with flexibility. The shape of the ink pack is changed by the amount of liquid inside the ink pack and a contact from outside. The ink pack case 25 has a function to regulate the flexibility of the ink pack. The ink pack is not configured to be easily removed from the apparatus in such a manner as to remove a so-called cartridge, and is configured so that a color of ink to be discharged from the head is changed by replacing the stored ink. In the droplet discharge apparatus 100, the ink pack is a so-called big tank and has a capacity larger than that of the cartridge.

In the description below, the ink pack corresponding to the "first head 11" of the plurality of ink packs provided in the droplet discharge apparatus 100 is referred to as the "first ink pack 21" and the ink pack corresponding to the "second head 12" is referred to as the "second ink pack 22".

The droplet discharge apparatus 100 further includes the cleaning liquid container 32 that stores the cleaning liquid and the waste liquid container 34 that stores liquid in addition to the ink packs described above. The cleaning liquid container 32 stores the cleaning liquid described above. The waste liquid container 34 stores liquid that is no longer required, such as ink, a mixture liquid of ink and cleaning liquid, and cleaning liquid.

The droplet discharge apparatus 100 further includes the first auxiliary container 81 that is coupled to the first head 11 and the second auxiliary container 82 that is coupled to the second head 12. The first auxiliary container 81 and the second auxiliary container 82 are included in the first flow path system 51 and the second flow path system 52, respectively, and stores the first ink and the second ink supplied from the first ink pack 21 and the second ink pack 22, respectively. Both the first auxiliary container 81 and the second auxiliary container 82 are open type, and thereby the pressures of ink applied to the first head 11 and the second head 12 are adjusted. Further, because of the open type, liquid can be sucked to an end side of the first flow path system 51.

1.4. Flow Path and Flow Path System

The droplet discharge apparatus 100 includes the common flow path system 42 that couples the first ink pack 21 with the second ink pack 22, the cleaning liquid flow path 44 that couples the common flow path system 42 with the cleaning liquid container 32, the first flow path system 51 that couples the first head 11 with the first ink pack 21, the second flow path system 52 that couples the second head 12 with the second ink pack 22, and the waste liquid flow path system 46 that couples the common flow path system 42 with the waste liquid container 34. Further, the droplet discharge apparatus 100 includes the air intake port 98 coupled to the cleaning liquid flow path 44.

Each of the first flow path system 51, the second flow path system 52, the common flow path system 42, the cleaning liquid flow path 44, the waste liquid flow path system 46, and the air intake port 98 is composed of a tube, a pipe, a combination of these, or the like. Each of these flow paths and flow path systems can cause liquid to flow. Arrangement and the like of these flow paths and flow path systems are optional and are not limited as long as they can be coupled in a predetermined manner.

1.5. Valves

The droplet discharge apparatus 100 includes the first valve 61 that controls the liquid flow rate between the common flow path system 42 and the first ink pack 21, the second valve 62 that controls the liquid flow rate between the common flow path system 42 and the second ink pack 22, the third valve 63 that controls the liquid flow rate between the common flow path system 42 and the cleaning liquid flow path 44, the fourth valve 64 that controls the liquid flow rate between the common flow path system 42 and the waste liquid flow path system 46, the fifth valve 65 provided in the first flow path system 51, and the sixth valve 66 provided in the second flow path system 52. Further, the droplet discharge apparatus 100 includes the seventh valve 67 at the branch portion between the air intake port 98 and the cleaning liquid flow path 44 and is configured to be able to select and send either the cleaning liquid or air to the common flow path system 42.

Each of these valve is a valve or the like. As the valve, any unit that can adjust a flow rate or select a flow path is appropriately used. Examples of the valve that selects a flow path include a three-way cock, a three-way valve, and the like. Although FIG. 1 shows an example in which a three-way cock is used as each valve, one three-way cock may be replaced with a plurality of valves.

The valve can select a flow path and change the magnitude of liquid flow rate and the like based on a signal from the control unit.

When the droplet discharge apparatus 100 is installed in a state in which the first ink is discharged from the first head 11, the common flow path system 42, the first valve 61, and the second valve 62 are arranged higher than the liquid surface 21*a* of the first ink in the first ink pack 21 and the liquid surface 22*a* of the second ink in the second ink pack 22. In each figure, the direction of gravity force G is indicated by an arrow. The common flow path system 42, the first valve 61, and the second valve 62 are arranged on the opposite side from the liquid surface 21*a* of the first ink in the first ink pack 21 and the liquid surface 22*a* of the second ink in the second ink pack 22 in the direction in which the gravity force G is applied.

Thereby, the ink in the ink packs can be washed and cleaned downward when the cleaning liquid is introduced into the ink packs from the common flow path system 42, so that cleaning effect is good. Further, the liquid surfaces of the ink in the ink packs can be pressed by introducing air into the ink packs from the common flow path system 42. If the first valve 61 and the second valve 62 are located at positions lower than the liquid surfaces of the ink, air is bubbled in the ink when introducing air into the ink packs from the common flow path system 42, so that dissolved gas in the ink is increased and, for example, there is a risk that bubbles are generated in the heads. On the other hand, such a problem can be reduced when the common flow path system 42, the first valve 61, and the second valve 62 are arranged higher than the liquid surface 21*a* of the first ink in the first ink pack 21 and the liquid surface 22*a* of the second ink in the second ink pack 22 as described above.

1.6. Pumps

The droplet discharge apparatus 100 includes the first pump 71 that is provided in the common flow path system 42 and feeds the first ink from the first ink pack 21 to the second ink pack 22 through the common flow path system 42, the second pump 72 that feeds the cleaning liquid from the cleaning liquid container 32 to the first ink pack 21 through the cleaning liquid flow path 44 and the common flow path system 42, the third pump 73 that feeds the cleaning liquid transferred to the first ink pack 21 from the first ink pack 21 to the waste liquid container 34 through the common flow path system 42 and the waste liquid flow path system 46, the fourth pump 74 that feeds the cleaning liquid from the cleaning liquid container 32 to the waste liquid container 34 through the cleaning liquid flow path 44, the common flow path system 42, and the waste liquid flow path system 46, and the fifth pump 75 provided between the first auxiliary container 81 and the first ink pack 21. The second pump 72 may send air instead of the cleaning liquid to each ink pack from the air intake port 98 through the cleaning liquid flow path 44 and the common flow path system 42 by an operation of the seventh valve 67.

A specific example of these pump is a pump. The type of pump is not particularly limited. A liquid feeding direction of the pump is appropriately designed. A pump whose liquid feeding direction can be selected may be used, and when such a pump is used, the number of the pumps may be reduced. In FIG. 1, there is a passage where a pump and a valve are provided in one liquid flow passage for explanation. However, the pump may double as the valve.

The pump changes a liquid flow rate, a liquid feeding direction, and the like based on a signal from the control unit.

1.7. Other Configurations

The droplet discharge apparatus 100 includes the first sensor 91 that detects the amount of liquid in the first ink pack 21 and the second sensor 92 that detects the amount of liquid in the second ink pack 22. Signals corresponding to each the amount of liquid detected by each sensor are referred to by the control unit.

The droplet discharge apparatus 100 has suction caps 95, each of which sucks liquid in a head from nozzles of the head. The suction cap 95 is provided corresponding to each head. The suction cap 95 is coupled with the suction flow path 48 that depressurizes the inside of the suction cap 95 when the suction cap 95 caps the head. The suction flow path 48 is provided with the sixth pump 96 which is configured so that liquid sucked to the suction flow path 48 is transferred to the waste liquid container 34. The liquid transferred from the suction cap 95 may be collected to a container different from the waste liquid container 34.

The droplet discharge apparatus 100 is provided with, for example, a mechanism that relatively moves the head and a recording medium in addition to the configuration described above, so that the droplet discharge apparatus 100 can perform ink jet type recording on the recording medium.

1.8. Control Unit

The droplet discharge apparatus 100 has the control unit not shown in the figures. The valves, the pumps, the caps, and the like are controlled based on a signal from the control unit. Further, the control unit can acquire a signal from each sensor and control each component based on the acquired signal.

2. Control of Droplet Discharge Apparatus

The droplet discharge apparatus 100 of the present embodiment can easily change the liquid discharged from the head to a different liquid. Hereinafter, an example will be described where the first ink and the second ink are the same ink, the first ink in the first ink pack 21 is removed, and the first ink pack 21 is cleaned, so that ink different from the first ink and the second ink can be introduced into the first ink pack 21.

Figure 2:
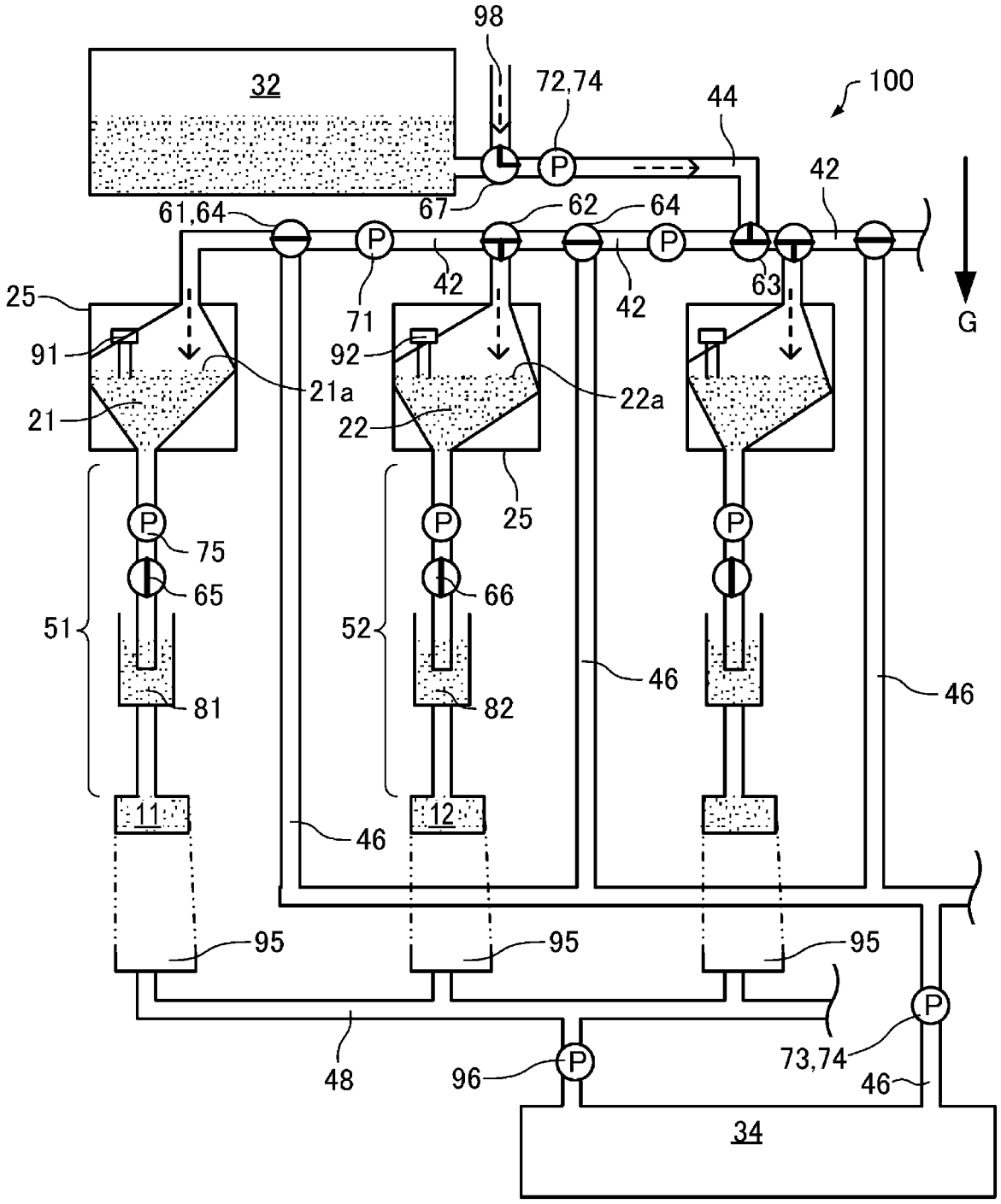
FIG. 2 is a schematic diagram showing a part of a control procedure of the main part of the droplet discharge apparatus according to the embodiment.
Figure 3:
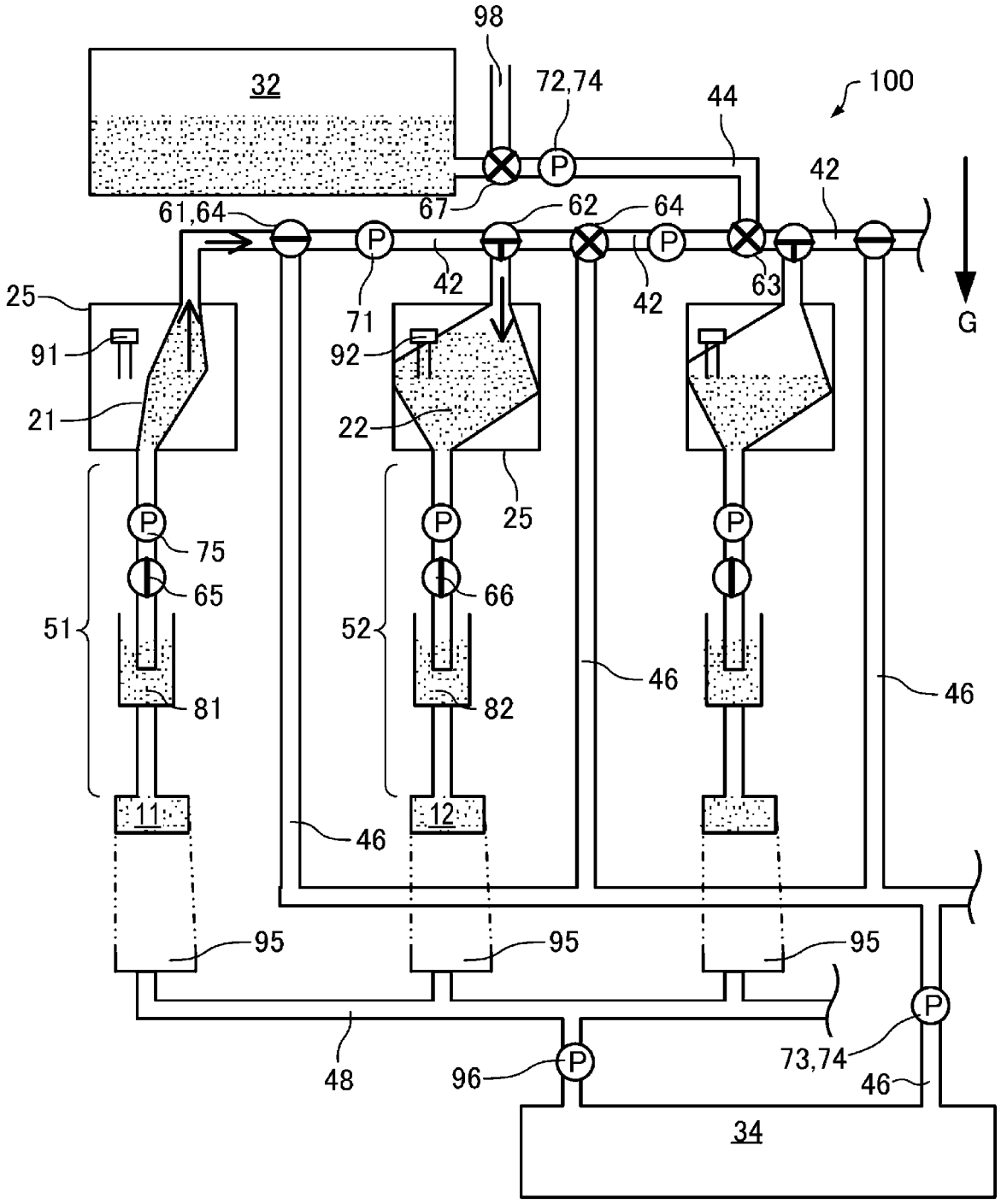
FIG. 3 is a schematic diagram showing a part of the control procedure of the main part of the droplet discharge apparatus according to the embodiment.
Figure 4:
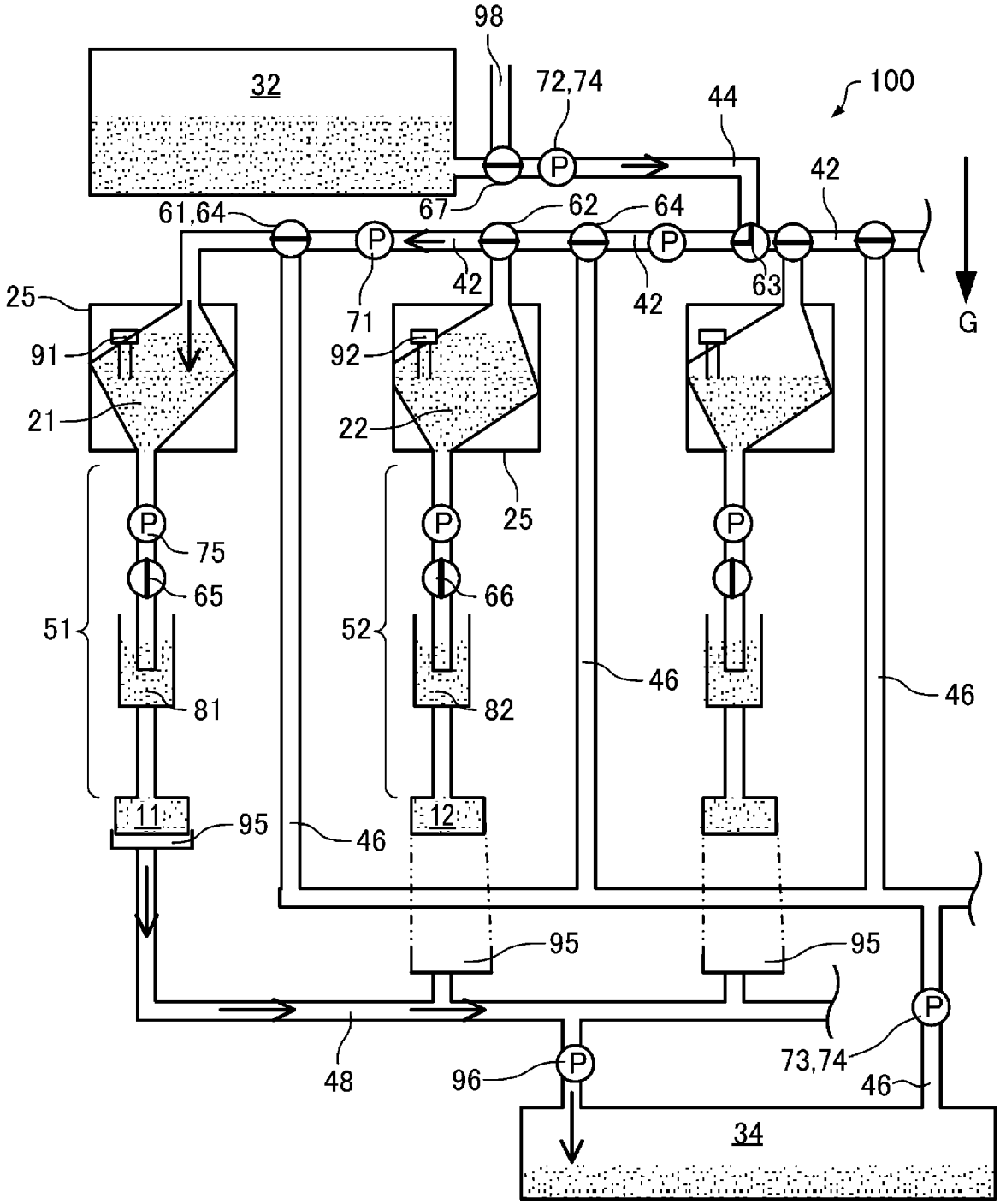
FIG. 4 is a schematic diagram showing a part of the control procedure of the main part of the droplet discharge apparatus according to the embodiment.

FIGS. 2 to 4 are schematic diagrams showing a procedure where the first ink and the second ink are the same ink, the first ink in the first ink pack 21 is removed, and the first ink pack 21 is cleaned.

FIG. 2 shows a state where the first ink is stored in the first ink pack 21, the first ink is discharged from the first head 11, the first ink is stored in the second ink pack 22, and the first ink is discharged from the second head 12. In the example of FIG. 2, the cleaning liquid flow path 44 and the air intake port 98 are communicated with each other by the seventh valve 67, and a state where air introduced from the air intake port 98 presses the surface of ink in each ink pack through the cleaning liquid flow path 44 and the common flow path system 42 is indicated by dashed line arrows. FIG. 2 shows three pairs of head and ink pack, and arbitrary ink is discharged from the head of the third pair. The number of the pairs of head and ink pack may be four or more.

In FIG. 2, each valve is a valve or a three-way valve, and an arrangement of each valve is indicated by a circular mark. A flow passage of the valve is displayed by a solid line in the circle. Further, when the flow path is closed by a flowing unit, X is displayed in the circle.

First, a procedure in which the cleaning liquid is introduced into the first ink pack 21 from a state shown in FIG. 2 will be described. This procedure is performed when the control unit transfers the first ink stored in the first ink pack 21 to the second ink pack 22 through the common flow path system 42 by controlling the first valve 61, the second valve 62, the third valve 63, and the first pump 71, and transfers the cleaning liquid stored in the cleaning liquid container 32 to the first ink pack 21 through the cleaning liquid flow path 44 and the common flow path system 42 by controlling the first valve 61, the second valve 62, the third valve 63, and the second pump 72.

Specifically, as shown in FIG. 3, the first ink pack 21 and the common flow path system 42 are communicated with each other by the first valve 61, and the second ink pack 22 and the common flow path system 42 are communicated with each other by the second valve 62. Thereby, a passage that communicates the first ink pack 21, the common flow path system 42, and the second ink pack 22 with each other is formed. Then, the first ink is transferred to the second ink pack 22 by driving the first pump 71.

Then, as shown in FIG. 4, the second valve 62 is closed, and the cleaning liquid flow path 44 and the common flow path system 42 are communicated with each other by the third valve 63. Thereby, a passage that communicates the cleaning liquid container 32, the cleaning liquid flow path 44, the common flow path system 42, and the first ink pack 21 with each other is formed. Then, the cleaning liquid is transferred to the first ink pack 21 by driving the second pump 72. In the case of this example, the cleaning liquid may be transferred by driving the first pump 71 instead of the second pump 72 in a direction opposite to the transfer direction of the first ink.

In this way, the cleaning liquid is introduced into the first ink pack 21, and the first ink pack 21 can be cleaned. Further, the amount of the first ink to be discarded can be reduced by transferring the first ink to the second ink pack 22.

Next, the cleaning liquid in the first ink pack 21 is transferred to the first head 11 through the first flow path system 51 by controlling the fifth valve 65. More specifically, as shown in FIG. 4, the fifth valve 65 is opened, the first head 11 is sealed by the suction cap 95, the first flow path system 51 is coupled to the suction flow path 48, and the sixth pump 96 is driven, so that the cleaning liquid that has cleaned the first ink pack 21 is transferred to the waste liquid container 34. Thereby, the cleaning liquid stored in the first ink pack 21 passes through the first flow path system 51, so that the cleaning liquid cleans the first flow path system 51. The sixth pump 96 may be driven after the cleaning liquid is sufficiently stored in the first ink pack 21 or may be driven at the same time when the cleaning liquid is introduced into the first ink pack 21.

Figure 5:
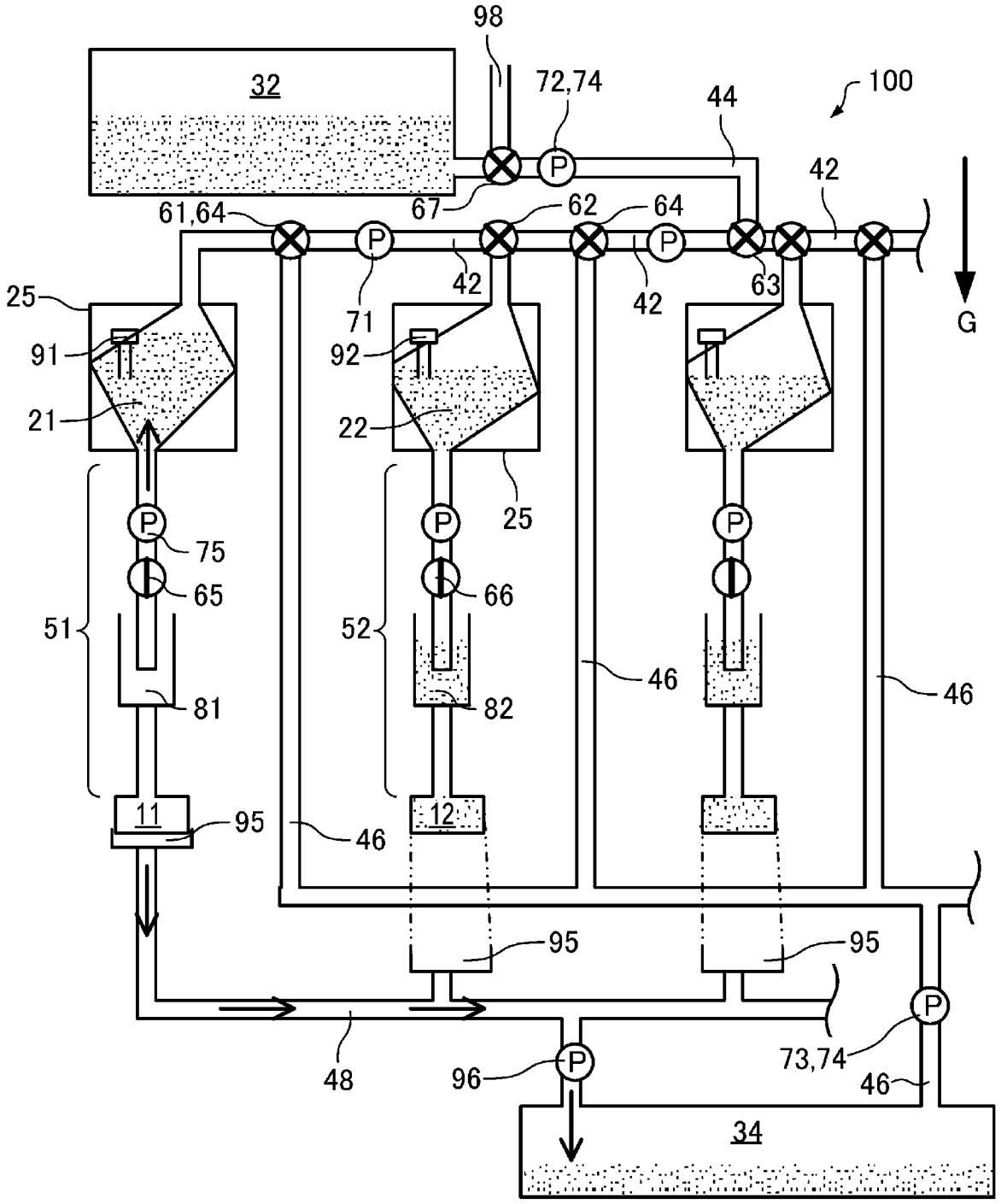
FIG. 5 is a schematic diagram showing a part of the control procedure of the main part of the droplet discharge apparatus according to the embodiment.

On the other hand, as shown in FIG. 5, the first ink in the first flow path system 51 on the first ink pack 21 side of the first auxiliary container 81 may be collected to the first ink pack 21 by opening the fifth valve 65 and driving the fifth pump 75 before transferring the first ink from the first ink pack 21 to the second ink pack 22. By doing so, it is possible to collect the first ink stored in the first auxiliary container 81 and further reduce the amount of the first ink to be discarded.

Figure 6:
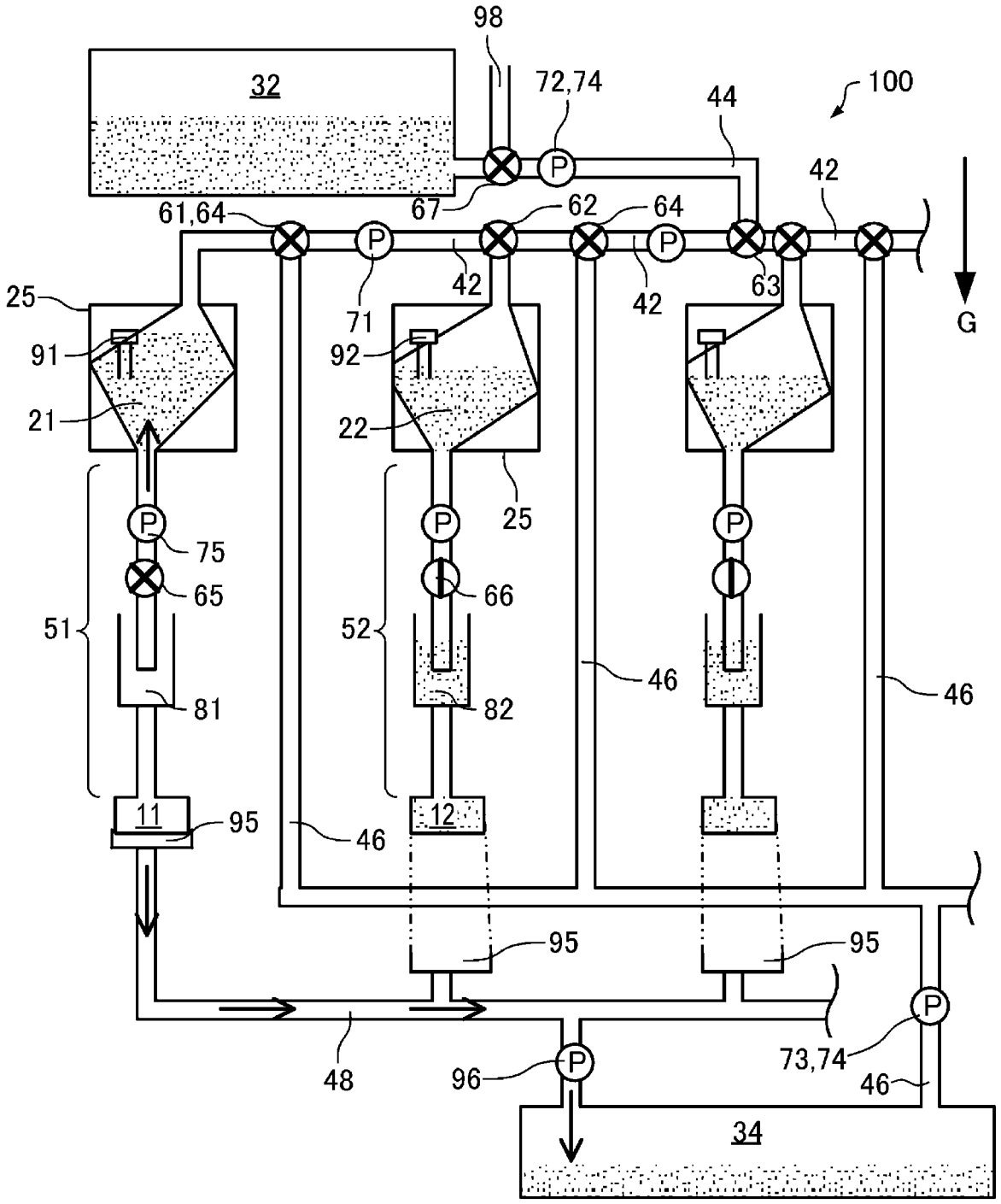
FIG. 6 is a schematic diagram showing a part of the control procedure of the main part of the droplet discharge apparatus according to the embodiment.

Further, as shown in FIG. 6, the first ink in the first auxiliary container 81 and the first head 11 may be transferred to the waste liquid container 34 by closing the fifth valve 65, capping the first head 11 with the suction cap 95, and driving the sixth pump 96 before transferring the cleaning liquid from the first ink pack 21 to the waste liquid container 34. By doing so, it is possible to discard in advance the first ink between the first auxiliary container 81 and the first head 11. Therefore, it is possible to further improve cleaning efficiency when the cleaning liquid passes through the first flow path system 51.

Figure 7:
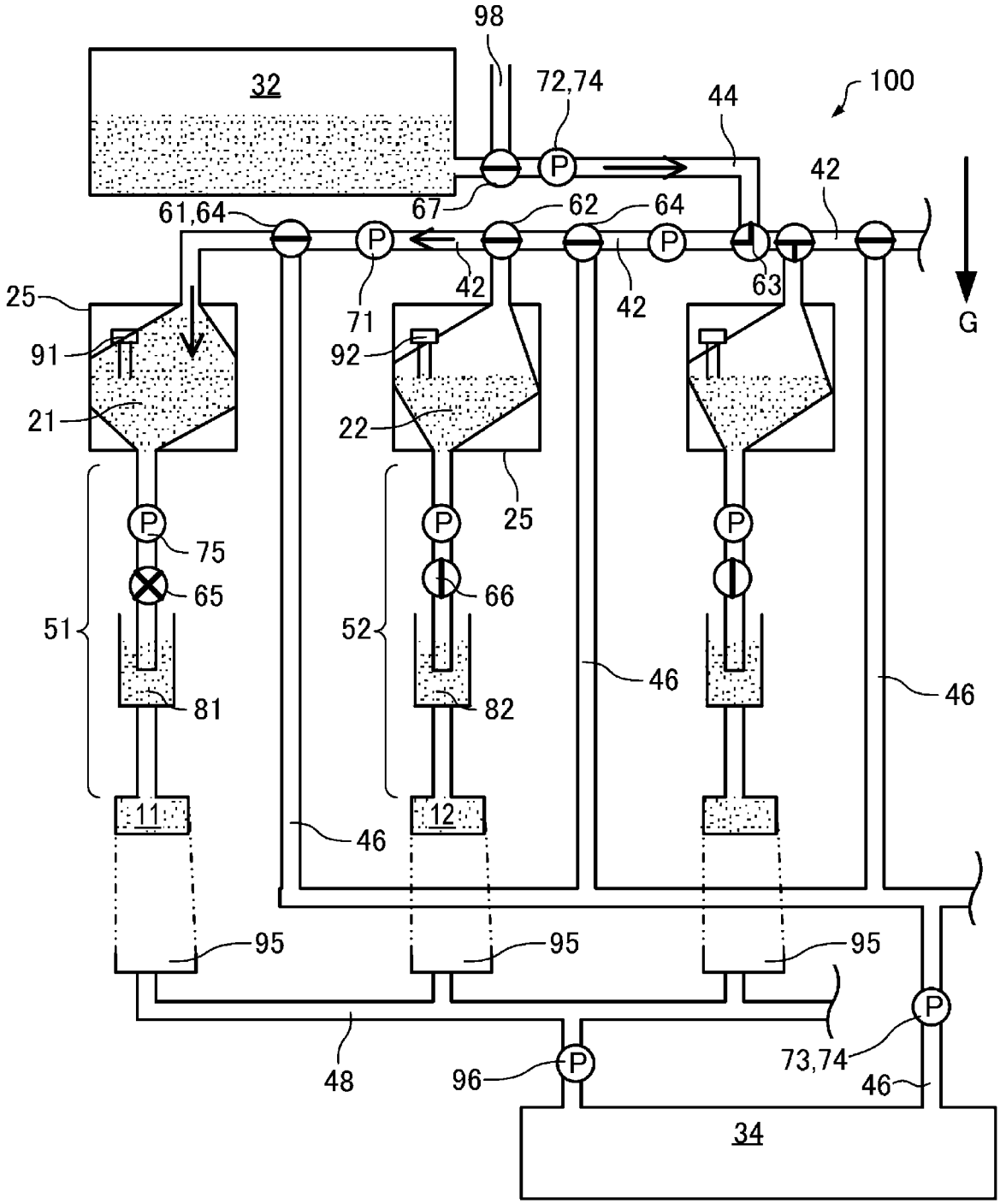
FIG. 7 is a schematic diagram showing a part of the control procedure of the main part of the droplet discharge apparatus according to the embodiment.

Further, as shown in FIG. 7, when the cleaning liquid stored in the cleaning liquid container 32 is transferred to the first ink pack 21 through the cleaning liquid flow path 44 and the common flow path system 42, a liquid flow rate of the first flow path system 51 may be reduced by controlling the fifth valve 65. In this case, the fifth valve 65 may be closed. By doing so, a larger amount of the cleaning liquid can be stored in the first ink pack 21, so that it is possible to more efficiently clean the first ink pack 21.

Figure 8:
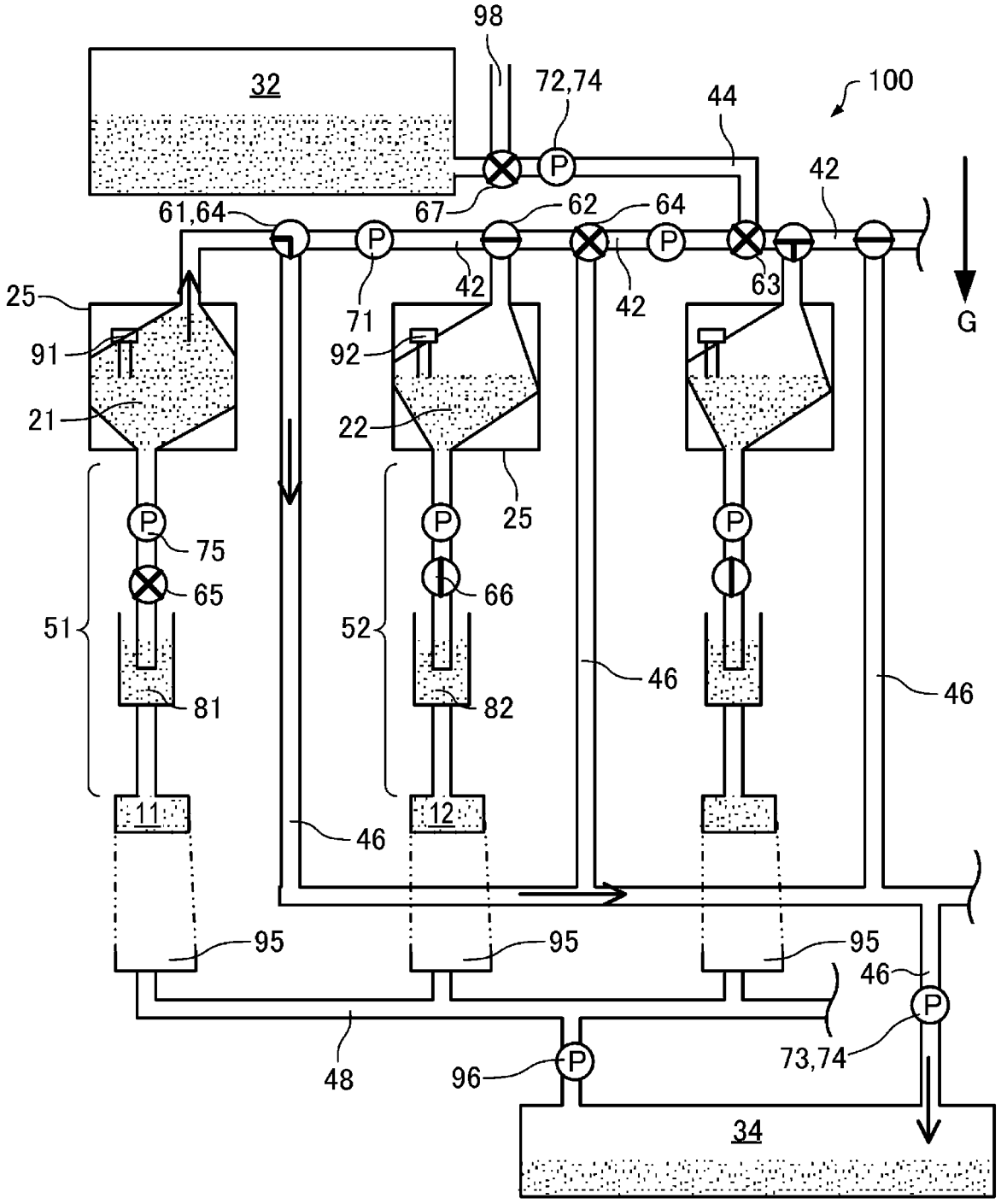
FIG. 8 is a schematic diagram showing a part of the control procedure of the main part of the droplet discharge apparatus according to the embodiment.

The cleaning liquid stored in the first ink pack 21 may be transferred to the waste liquid container 34 through a passage other than the first flow path system 51. FIG. 8 shows an example in which the cleaning liquid transferred to the first ink pack 21 is transferred to the waste liquid container 34 through the waste liquid flow path system 46 by controlling the first valve 61, the fourth valve 64, and the third pump 73. As shown in FIG. 8, the cleaning liquid in the first ink pack 21 can be transferred to the waste liquid container 34 through the waste liquid flow path system 46 by causing the first valve 61 to communicate the first ink pack 21 and the waste liquid flow path system 46 with each other and driving the third pump 73 provided on the waste liquid flow path system 46. In the examples shown in the figures, the first valve 61 and the fourth valve 64 are common.

By doing so, the cleaning liquid in the first ink pack 21 can be transferred to the waste liquid container 34 without through the first flow path system 51. Therefore, for example, when a foreign object occurs in the first ink pack 21, it is possible to prevent the foreign object from passing through the first head 11. Specifically, in the first head 11, there are flow paths with small flow path diameter such as nozzles, flow path resistance portions, and filters, so that if a foreign object enters into the first head 11, there is a risk of occurrence of clogging. On the other hand, in the configuration described above, the cleaning liquid in the first ink pack 21 is transferred to the waste liquid container 34 without through the first flow path system 51. Therefore, it is possible to suppress clogging of the first head 11 even when there is a foreign object.

When the cleaning liquid in the first ink pack 21 is transferred to the waste liquid container 34 through the waste liquid flow path system 46, the cleaning liquid may be transferred to the waste liquid container 34 through two passages, which are the waste liquid flow path system 46 and the first flow path system 51, by opening the fifth valve 65. Thereby, it is possible to increase a transfer speed of the cleaning liquid from the first ink pack 21 to the waste liquid container 34, so that cleaning time can be shortened.

Figure 9:
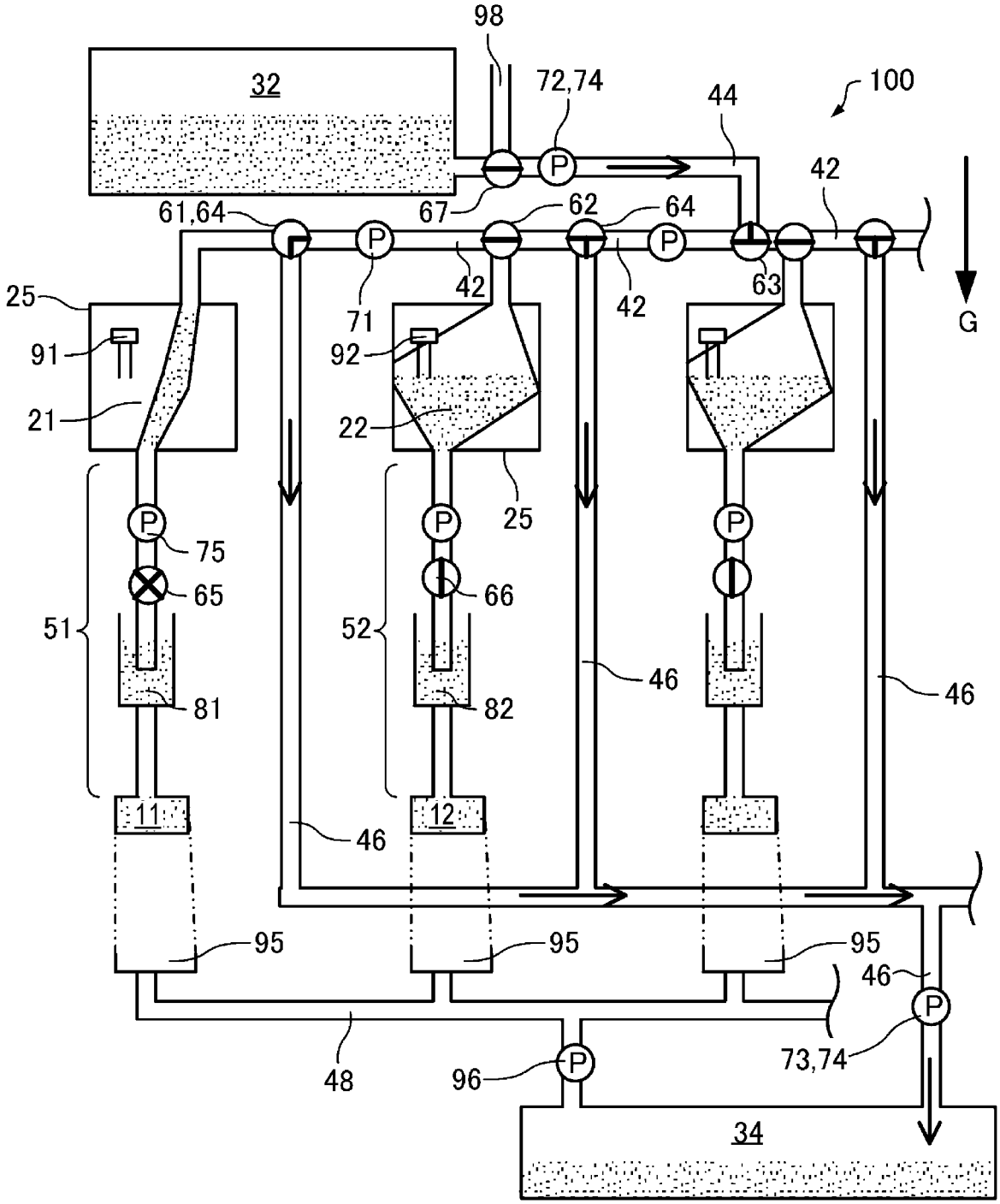
FIG. 9 is a schematic diagram showing a part of the control procedure of the main part of the droplet discharge apparatus according to the embodiment.

As described above, the common flow path system 42 let both the first ink and the cleaning liquid to pass through. Therefore, it is possible to more smoothly perform the next above operation by cleaning the common flow path system 42 with the cleaning liquid. Specifically, the cleaning liquid stored in the cleaning liquid container 32 may be transferred to the waste liquid container 34 through the cleaning liquid flow path 44, the common flow path system 42, and the waste liquid flow path system 46 by controlling the first valve 61, the second valve 62, the third valve 63, the fourth valve 64, and the fourth pump 74. More specifically, as shown in FIG. 9, the common flow path system 42 and the waste liquid flow path system 46 are communicated with each other by the first valve 61 and the second valve 62, and the cleaning liquid flow path 44 and the common flow path system 42 are communicated with each other by the third valve 63. When the fourth pump 74 is driven, the cleaning liquid can be transferred to the waste liquid container 34 through the cleaning liquid flow path 44, the common flow path system 42, and the waste liquid flow path system 46.

In the example of FIG. 9, the first valve 61 doubles as the fourth valve 64. These valves may be provided separately from each other. The fourth pump 74 doubles as the second pump 72 and the third pump 73. These pumps may be provided separately from each other. Regarding these fourth pumps 74, it is enough to provide at least one fourth pump 74. Further, in the example of FIG. 9, a region of the common flow path system 42 other than a region of the common flow path system 42 through which the first ink passes is also cleaned by the above operation. By doing so, it is possible to easily maintain a clean state of the entire common flow path system 42.

In the droplet discharge apparatus 100, the second ink pack 22 is provided with the second sensor 92 that detects the amount of liquid inside the second ink pack 22. When the first ink is transferred from the first ink pack 21 to the second ink pack 22, if the second sensor 92 detects that the amount of liquid in the second ink pack 22 exceeds a predetermined amount, the second ink in the second ink pack 22 may be transferred to the second auxiliary container 82 by opening the sixth valve 66. By doing so, a larger amount of the first ink can be stored in the second ink pack 22, so that it is possible to further suppress waste of ink.

In the droplet discharge apparatus 100, the first ink pack 21 is provided with the first sensor 91 that detects the amount of liquid inside the first ink pack 21. When the total amount of the amount of liquid in the first ink pack 21 detected by the first sensor 91 and the amount of liquid in the second ink pack 22 detected by the second sensor 92 exceeds the amount of liquid that can be stored in the second ink pack 22, the second ink in the second ink pack 22 may be transferred to the second auxiliary container 82 by opening the sixth valve 66.

Further, when the amount of liquid in the first ink pack 21 detected by the first sensor 91 is smaller than the amount of liquid in the second ink pack 22 detected by the second sensor 92, the first ink stored in the first ink pack 21 may be transferred to the second ink pack 22 through the common flow path system 42. That is, when the first ink and the second ink are the same ink and another ink is filled into either one of the first ink pack 21 and the second ink pack 22, any one of the first ink pack 21 and the second ink pack 22 can be cleaned and emptied by the procedure described above. However, it is preferable to clean and empty the ink pack containing less ink between the first ink pack 21 and the second ink pack 22. By doing so, the amount of transfer of ink between the first ink pack 21 and the second ink pack 22 can be reduced, so that, for example, it is possible to reduce time to perform the above procedure.

As described above, the droplet discharge apparatus 100 of the present embodiment can suppress waste of ink and easily form an acceptance state for replacing ink. Therefore, when a user replaces ink, it is easy to prepare a cleaned ink pack into which ink is to be filled, and desired recording can be performed when the user introduces a desired ink into the ink pack.

While a replacing method of ink in the droplet discharge apparatus 100 is described in the present embodiment, an ink system including the first head 11, the second head 12, the first ink pack 21, the second ink pack 22, the common flow path system 42, the first flow path system 51, and the second flow path system 52 may be attached to and detached from the droplet discharge apparatus. In this case, a cleaning apparatus including the cleaning liquid container 32, the waste liquid container 34, the cleaning liquid flow path 44, the waste liquid flow path system 46, the suction flow path 48, and the suction caps 95 is configured. The cleaning apparatus is a different body from the droplet discharge apparatus. The ink system is attached to the cleaning apparatus and performs replacement of ink. By doing so, another ink system can be attached to the droplet discharge apparatus, so that it is not necessary to stop the droplet discharge apparatus for an ink replacement operation.

The present disclosure is not limited to the embodiment described above, but can be variously modified. For example, the present disclosure includes substantially the same configuration as that described in the embodiment, such as, for example, a configuration having the same functions, methods, and results, or a configuration having the same object and effects. Further, the present disclosure includes a configuration in which non-essential portions of the configuration described in the embodiment are replaced. Further, the present disclosure includes a configuration that achieves the same operational effects or can achieve the same object as those of the configuration described in the embodiment. Further, the present disclosure includes a configuration in which a known technique is added to the configuration described in the embodiment.

What is claimed is:

1. A droplet discharge apparatus comprising:

a first head;

a first ink pack that stores first ink to be supplied to the first head;

a second head;

a second ink pack that stores second ink to be supplied to the second head;

a cleaning liquid container that stores cleaning liquid;

a common flow path system that couples the first ink pack with the second ink pack;

a cleaning liquid flow path that couples the common flow path system with the cleaning liquid container;

a first valve that controls a liquid flow rate between the common flow path system and the first ink pack;

a second valve that controls a liquid flow rate between the common flow path system and the second ink pack;

a third valve that controls a liquid flow rate between the common flow path system and the cleaning liquid flow path;

a first pump that is provided in the common flow path system and feeds the first ink from the first ink pack to the second ink pack through the common flow path system;

a second pump that feeds the cleaning liquid from the cleaning liquid container to the first ink pack through the cleaning liquid flow path and the common flow path system; and a control unit, wherein when the droplet discharge apparatus is installed in a state in which the first ink is discharged from the first head, the common flow path system, the first valve, and the second valve are located higher than a liquid surface of the first ink in the first ink pack and a liquid surface of the second ink in the second ink pack, and the control unit transfers the first ink stored in the first ink pack to the second ink pack through the common flow path system by controlling the first valve, the second valve, the third valve, and the first pump, and transfers the cleaning liquid stored in the cleaning liquid container to the first ink pack through the cleaning liquid flow path and the common flow path system by controlling the first valve, the second valve, the third valve, and the second pump.

2. The droplet discharge apparatus according to claim 1, further comprising:

a waste liquid container;

a waste liquid flow path system that couples the common flow path system with the waste liquid container;

a fourth valve that controls a liquid flow rate between the common flow path system and the waste liquid flow path system; and a third pump that feeds the cleaning liquid transferred to the first ink pack from the first ink pack to the waste liquid container through the waste liquid flow path system, wherein the control unit transfers the cleaning liquid transferred to the first ink pack to the waste liquid container through the waste liquid flow path system by controlling the first valve, the fourth valve, and the third pump.

3. The droplet discharge apparatus according to claim 2, further comprising:

a fourth pump that feeds the cleaning liquid from the cleaning liquid container to the waste liquid container through the cleaning liquid flow path, the common flow path system, and the waste liquid flow path system, wherein the control unit transfers the cleaning liquid stored in the cleaning liquid container to the waste liquid container through the cleaning liquid flow path, the common flow path system, and the waste liquid flow path system by controlling the first valve, the second valve, the third valve, the fourth valve, and the fourth pump.

4. The droplet discharge apparatus according to claim 2, wherein the waste liquid container stores liquid discharged from the first head.

5. The droplet discharge apparatus according to claim 1, further comprising:

a first flow path system that couples the first head with the first ink pack; and a fifth valve provided in the first flow path system, wherein the control unit transfers the cleaning liquid transferred to the first ink pack to the first head through the first flow path system by controlling the fifth valve.

6. The droplet discharge apparatus according to claim 5, wherein the control unit reduces a liquid flow rate of the first flow path system by controlling the fifth valve when transferring the cleaning liquid stored in the cleaning liquid container to the first ink pack through the cleaning liquid flow path and the common flow path system.

7. The droplet discharge apparatus according to claim 5, wherein the first flow path system includes a first auxiliary container coupled to the first head, and a fifth pump provided between the first auxiliary container and the first ink pack, and the control unit collects the first ink stored in the first auxiliary container into the first ink pack by controlling the fifth pump before transferring the first ink stored in the first ink pack to the second ink pack through the common flow path system.

8. The droplet discharge apparatus according to claim 1, further comprising:

a second flow path system that couples the second head with the second ink pack;

a sixth valve provided in the second flow path system;

a first sensor that detects an amount of liquid in the first ink pack;

a second sensor that detects an amount of liquid in the second ink pack; and a second auxiliary container coupled to the second head, wherein the control unit transfers the second ink in the second ink pack to the second auxiliary container by controlling the sixth valve when a total amount of the amount of liquid in the first ink pack detected by the first sensor and the amount of liquid in the second ink pack detected by the second sensor exceeds a predetermined amount before transferring the first ink stored in the first ink pack to the second ink pack through the common flow path system.

9. The droplet discharge apparatus according to claim 1, further comprising:

a second flow path system that couples the second head with the second ink pack;

a sixth valve provided in the second flow path system;

a second sensor that detects an amount of liquid in the second ink pack; and a second auxiliary container coupled to the second head, wherein the control unit transfers the second ink in the second ink pack to the second auxiliary container by controlling the sixth valve when the second sensor detects that the amount of liquid in the second ink pack exceeds a predetermined amount.

10. The droplet discharge apparatus according to claim 1, further comprising:

a first sensor that detects an amount of liquid in the first ink pack; and a second sensor that detects an amount of liquid in the second ink pack, the control unit transfers the first ink stored in the first ink pack to the second ink pack through the common flow path system when the amount of liquid in the first ink pack detected by the first sensor is smaller than the amount of liquid in the second ink pack detected by the second sensor.

11. The droplet discharge apparatus according to claim 1, wherein the first ink and the second ink are the same ink.

* * * * *